US005882212A

United States Patent [19]

McHugh et al.

[11] Patent Number: 5,882,212

[45] Date of Patent: Mar. 16, 1999

[54] CONNECTOR APPARATUS FOR ELECTRICALLY CONNECTING PRINTED CIRCUIT BOARDS

[75] Inventors: Robert G. McHugh, Evergreen, Colo.; Yu Ming Ho, Taipei Hsien, Taiwan

[73] Assignee: Foxconn International, Inc., Sunnyvale, Calif.

[21] Appl. No.: 971,362

[22] Filed: Nov. 17, 1997

Related U.S. Application Data

[63] Continuation of Ser. No. 540,666, Oct. 11, 1995, abandoned.

[51] Int. Cl.[6] ..... H01R 9/09; H01R 23/02

[52] U.S. Cl. ..... 439/74; 439/660

[58] Field of Search ..... 439/74, 83, 660

[56] References Cited

U.S. PATENT DOCUMENTS

| | | | |
|---|---|---|---|
| 4,478,471 | 10/1984 | Olsson | 439/267 |
| 5,057,027 | 10/1991 | Yamada | 439/83 |
| 5,161,985 | 11/1992 | Ramsay | 439/74 |
| 5,192,232 | 3/1993 | Lenz et al. | 439/660 |
| 5,199,884 | 4/1993 | Kaufman et al. | 439/74 |
| 5,277,597 | 1/1994 | Masami et al. | 439/83 |
| 5,302,134 | 4/1994 | Thomas | 439/571 |
| 5,310,357 | 5/1994 | Olson | 439/346 |

*Primary Examiner*—Neil Abrams

*Attorney, Agent, or Firm*—Birch, Stewart, Kolasch & Birch, LLP

[57] ABSTRACT

A connector apparatus for electrically connecting printed circuit boards together includes a male and a female connector. The male connector includes a connector body (1). The body (1) has a central connecting block (11) on the bottom. The external surface of the bottom of the body provides a number of contact terminal holes (15). A number of double-L-shaped contact terminals (2) each having a bent contact portion (23) is installed inside a corresponding one of the contact terminal containing spaces (16). The soldering end (22) extends out of the corresponding one of the contact terminal holes (15) in a direction perpendicular to the longitudinal axis of the body. The female connector includes a connector body (3) with a number of parallel contact terminal containing spaces (32) extending in a direction perpendicular both to the longitudinal axis and the bottom of the body. The external surface of the bottom has a number of contact terminal holes (35) each connected to and aligned with a corresponding one of the contact terminal containing spaces (32). A number of L-shaped contact terminals (4) each having a slightly inclined contact receiving end is installed inside a corresponding one of the contact terminal containing spaces (32). One-way latching protrusions (41) are formed on the center section of the contact terminal (4) for latching into the stopping planes. A soldering end (42) extends out of the corresponding one of the contact terminal holes in a direction substantially perpendicular to the longitudinal axis of the body (3).

15 Claims, 9 Drawing Sheets

CONNECTOR APPARATUS FOR ELECTRICALLY CONNECTING PRINTED CIRCUIT BOARDS

This application is a continuation of application Ser. No. 08/540,666 filed on Oct. 11, 1995, now abandoned.

BACKGROUND OF THE INVENTION

1. Field of the Invention

The present invention relates in general to connector means for printed circuit boards. In particular, the present invention relates to a pair of matching male and female connector means for providing firm and secure electrical connection between two printed circuit boards.

2. Technical Background

Board-to-board connector means for connecting two separate printed circuit boards are known. In general, male and female connectors having matching electrical contact terminal means are each fixedly attached to one of the pair of printed circuits to be connected together. Conventional board-to-board connector means are varied in configuration. They are generally utilized in the connection, or relaying, of a number of electrical signals between the two separate printed circuit boards.

Several disadvantages are present in conventional board-to-board connector means. For example, many of the connector means employing straight-line type of contact electrical conducting terminals when subjected to pressure become buckled in shape during the process of being inserted into their respectively assigned spaces in the plastic body of the connector means. A connector means having one or more buckled contact metal contact terminals is considered defective and may cause problem of unstable or even failed electrical connection if used in printed circuit boards.

If any one of the contact terminals is not properly installed in the containing space of a connector body, it may be damaged when the matching male or female connector is connected thereto when the connection between the two connectors is attempted. Such connection frequently results in a damaged contact terminal, since the contact terminal not properly in place would inevitably be twisted and subjected to un-normal mechanical stress. In addition to the physical damage to the connector itself, there is also the probability of an electrical signal becoming short circuited between the neighboring contact signal paths.

Mating made between a pair of connectors is normally oriented in a predetermined direction. In other words, each of the contact terminals in one connector normally has a fixed matching relationship with a corresponding contact terminal in the other of two mating connectors. Carelessness in the process of making a connection may mis-align the orientation in the connection, and the forced mating of two incorrectly aligned connectors would damage the connector bodies and result in erroneous connection of the electrical signals between two printed circuit boards. On some occasions, a misaligned connector connection results in electrical damage to the circuitries in either or both of the two printed circuit boards.

Certain types of connectors have connector contact terminal pins extending out of the plastic body of the connector. These contact terminal pins, due to their requirement to be inserted into the corresponding through-holes on the printed circuit board for soldering thereto, must have sections sufficiently long that are exposed out of the plastic body of the connector. These solder pins are easily bent and may obscure the smooth and proper insertion of each and every pin into the corresponding through-holes in the printed circuit board. The result would sometimes be that certain bent pins are not inserted into the holes at all, causing failure of electrical signal contact, or the bent pins short circuit the pins next to them.

Moreover, as the physical dimensions of the modern connectors are becoming smaller, the tolerance between the contact pins at the end of soldering and the corresponding containing space is so small to cause a capillary phenomena that sucks solder upwards. This results in poor soldering quality downward in the through-hole.

SUMMARY OF THE INVENTION

It is therefore an object of the present invention to provide a connector apparatus for connecting printed circuit boards that is free from contact terminal buckling during the process of connector manufacturing.

It is another object of the present invention to provide a connector apparatus for connecting printed circuit boards where all contact terminals may be correctly installed in the corresponding containing spaces in the connector body to prevent contact terminal damaging when the mating connectors are connected together.

It is still another object of the present invention to provide a connector apparatus for connecting printed circuit boards that prevents misalignment when the mating connectors are connected together.

It is yet another object of the present invention to provide a connector apparatus for connecting printed circuit boards that prevents the capillary sucking of solder into the internal through-holes of the connector apparatus to cause short-circuiting.

The present invention further achieves the above-identified objects by providing a connector apparatus for electrically connecting printed circuit boards together which includes a male and a female connector. The male connector comprises a connector body that is substantially a rectangular box. The body has a central connecting block protruding from the bottom of the box. There are formed on the two longitudinal side walls of the central connecting block a number of parallel spacer walls. The external surface of the bottom has formed thereon a number of contact terminal holes each connected to and aligned with a corresponding contact terminal containing space defined between every consecutive two of the spacer walls. An alignment slot is formed on the exterior bottom surface of the body connecting to the exterior opening of each of the contact terminal hole. A number of generally double-L-shaped contact terminals each having a bent contact portion is installed inside a corresponding one of the contact terminal containing spaces. One-way latching protrusions formed on the center section of the contact terminal latch into the stopping planes. The soldering end extends out of the corresponding one of the contact terminal holes in a direction substantially perpendicular to the longitudinal axis of said body. The female connector comprises a connector body that is substantially an opened elongated rectangular box having formed on the two longitudinal internal side walls thereof a number of parallel contact terminal containing spaces extending in a direction perpendicular both to the longitudinal axis and the bottom of the body. The external surface of the bottom has formed thereon a number of contact terminal holes each connected to and aligned with a corresponding one of the contact terminal containing spaces. An alignment slot is each formed on the exterior bottom surface of the body connecting to the exterior opening of each of the contact terminal hole. A number of generally L-shaped contact terminals each having a slightly inclined contact receiving end are installed inside a corresponding one of the contact terminal containing spaces. One-way latching protrusions are formed on the center section of the contact terminal for latching into the stopping planes. A soldering end extends out of the corresponding one of the contact terminal.

BRIEF DESCRIPTION OF THE DRAWINGS

Other objects, features, and advantages of the present invention will become apparent by way of the following detailed description of the preferred but non-limiting embodiments. The description is made with reference to the accompanied drawings in which.

DETAILED DESCRIPTION OF THE PREFERRED EMBODIMENT

Figure 1:
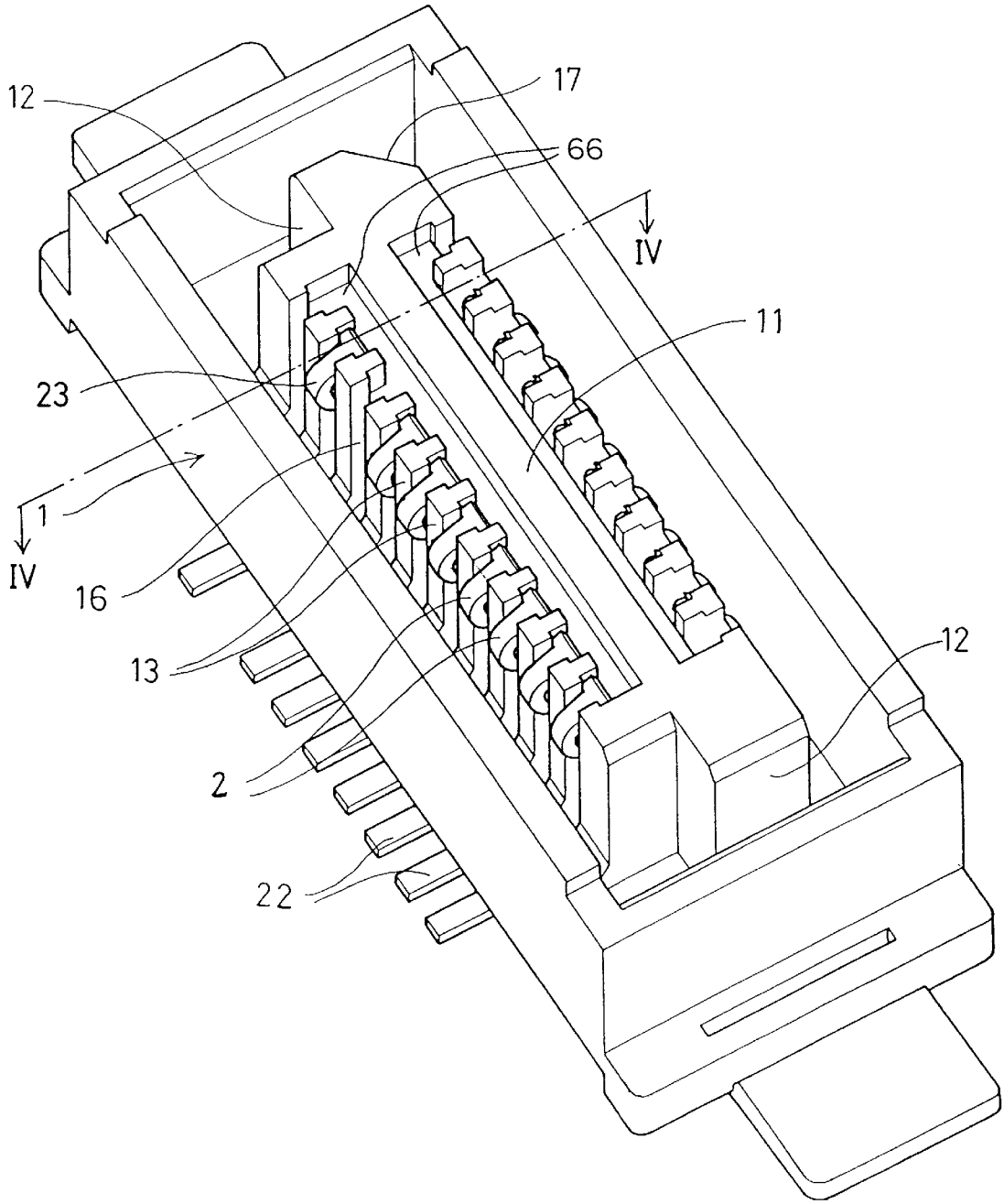
FIG. 1 is a perspective view of a male connector in accordance with a preferred embodiment of the present invention.
Figure 2:
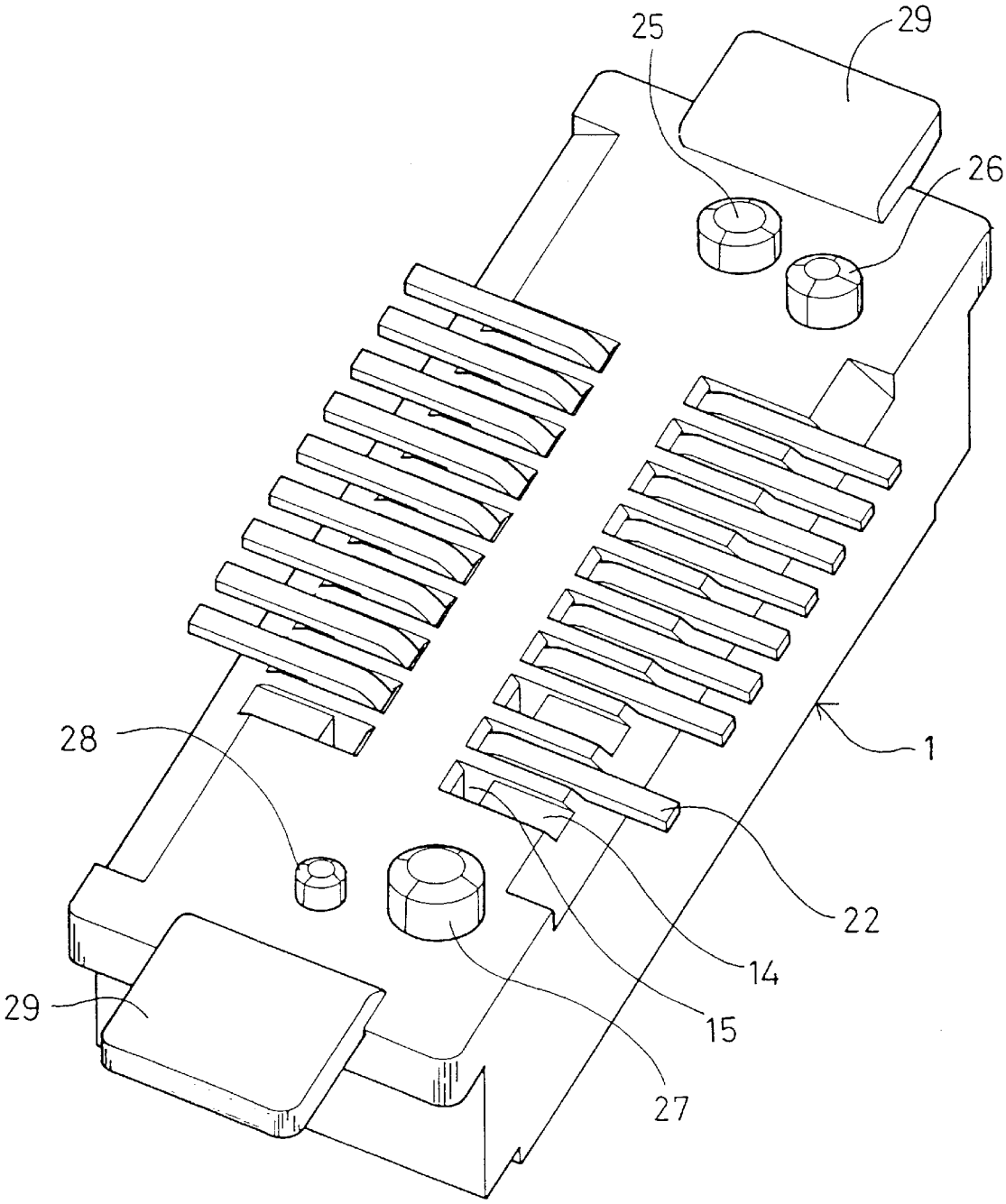
FIG. 2 is a perspective view of the male connector of FIG. 1 shown in another perspective angle.

The connector apparatus for connecting separate printed circuit boards together in accordance with a preferred embodiment of the present invention is comprised of two connector pieces, the first one being the male and the second being the female connector. For a description of the connector apparatus of the present invention, reference is directed first to FIGS. 1 and 2 of the accompanying drawings of the present invention. FIG. 1 is a perspective view of a male connector in accordance with a preferred embodiment of the present invention, and FIG. 2 is a perspective view of the male connector of FIG. 1 shown in another perspective angle. Basically, the perspective view of FIG. 1 shows the male connector in an angle observing the connector connecting means, while that of FIG. 2 shows the same connector of the details of its other side that provides for soldering connection to the printed circuit board.

As is seen in FIGS. 1 and 2, the male connector comprises a body 1 of, for example, plastic material that is basically an opened rectangular box containing an island-shaped central connecting block 11. Each of the two sidewalls of the central connecting block 11 has arranged thereon one row of a number of contact terminals 2 that are made of electrically conducting material. The number of contact terminals populated on both sides of the central connecting block 11 can be varied. In principle, the pitch of the contact terminal 2 population is fixed. If the number of contact terminals 2 are required to be larger, then the central connecting block 11, as well as the entire connector body 1, would be lengthened. On the other hand, the number of contact terminal arrangement on both sides of the central connecting block 11 may or may not be the same.

Each of the contact terminals is contained in its corresponding containing space 16 recessed into the surface of the side of the central connecting block 11. Each of the recessed containing spaces 16 is enclosed in the plane of the surface of the central connecting block 11 by a pair of spacer walls 13 at both sides. To accommodate the connection with a corresponding female connector to be described later, all of the installed contact terminals 2, the spacer walls 13 and the containing spaces 16 have their respective longitudinal axes aligned in parallel and are perpendicular to the longitudinal axis of the body 1 of the connector itself. The longitudinal axes of the contact terminal containing spaces 16 are also aligned with the direction of the insertion of the female connector not shown. In the drawing of FIG. 1, one of the contact terminal containing spaces 16 is shown to be not populated by contact terminals. This is to show the spatial configuration of a containing space for the contact terminal 2.

At both ends of the central connecting block 11, there is formed within the confinement of the sidewalls of the body 1 a generally L-shaped alignment slot 12. One of the two L-shaped alignment slots 12 have a cut off orientation edge 17.

The installation of each of the contact terminals 2 in the recessed containing space 16 on the sides of the central connecting block 11 is effected by inserting one end thereof into the corresponding terminal hole 15 made on the bottom surface of the body 1, as is seen in FIG. 2. Each of the terminal holes 15 is aligned in one of two rows in the bottom surface of the body 1 and is aligned with the corresponding contact terminal containing space 16 as enclosed by the corresponding pair of spacer walls 13.

Each of the terminal holes 15 is located on the bottom surface of the body 1 and has connected thereto a contact terminal alignment slot 14. Each of the terminal alignment slots 14 is connected to the opening of the corresponding terminal hole 15 and has a longitudinal axis perpendicular to the longitudinal axis of the body 1. Each of the alignment slots 14 is a guiding slot that is recessed into the bottom surface of the body 1. This allows alignment of the soldering end 22 of every contact terminal 2 in the desired parallel direction as shown in the drawing. Two of the alignment slots 14 are shown in FIG. 2 to be not populated by the contact terminals 2, for the purpose of the showing the configuration thereof.

Several of the connector orientation means for correctly aligning the connector itself when mounted onto the printed circuit board are provided on the bottom surface of the body 1. For example, the orientation control and alignment studs 25, 26, 27 and 28 may be provided to protrude out of the bottom surface of the body 1. Three of the studs 25, 26 and 27 may generally be of the same diameter, while the fourth stud 28 may have a relatively smaller diameter. Through-holes with corresponding diameters must be present on the printed circuit board so that the studs may pass through and allows for the body 1 to be lowered on the printed circuit board, until the soldering ends 22 of the contact terminals 2 contact their corresponding mounting pads on the printed circuit board. This arrangement prevents incorrect orientation when the connector itself is mounted on the printed circuit board.

The depth of the recession of the alignment slot 14 into the bottom surface of body 1, however, is smaller than the thickness of the soldering end 22 of the contact terminal 2. In essence, the level of the elevation of the bottom surface of the soldering end 22 of the contact terminals 2 below the bottom surface of the connector body 1 must be lower than any other portions of the body 1, for example, the end plates 29 that are located on the surface of the printed circuit board to which the connector is to be mounted by soldering.

Figure 3:
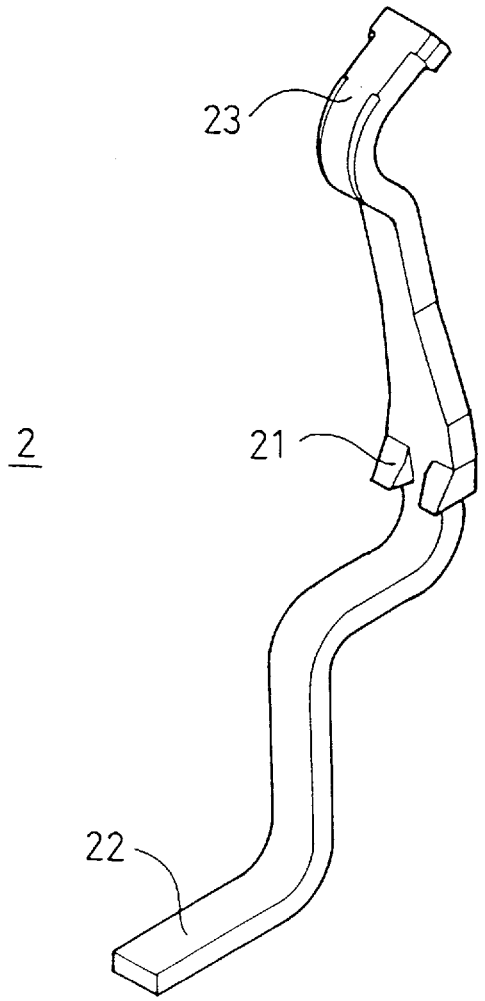
FIG. 3 is a perspective view of the contact terminal for the male connector of FIG. 1.

For a description of the contact terminals 2 used in the male connector, refer to FIG. 3 for a perspective view of the contact terminal 2 for the male connector of FIG. 1. As is seen in the perspective view, the contact terminal 2 is in general a double-L-shaped metal piece. The contact terminal 2 serves to provide an electrical connection from the circuitries on a printed circuit board to the circuitries on another printed circuit board. Both the male and female connectors are soldered to respective circuit boards to provide this connection. The establishment of the electrical connection lends portion of its path via the contact terminal 2. As is easily comprehensible, the soldering end 22 of the contact terminal is at one end of the electrical connection, and the bent contact portion 23 is at the other end. The soldering end 22 is securely surface-mounted onto the printed circuit board, and the bent contact portion 23, on the other hand, makes its contact to the corresponding contact point in the female connector that matches the male connector by connection.

When the male connector is manufactured by assembling the contact terminals 2 into the body 1 of the male connector, the end of the bent contact portion 23 of each of the contact terminals 2 is inserted into one corresponding contact terminal containing space 16 on the side wall of the central connecting block 11, as is the situation shown in FIG. 1. The soldering end 22 of the contact terminal 2, on the other hand, is left outside of the body 1 of the male connector, in the alignment slot 14, allowing for the mounting on the surface-mounting pads on the printed circuit board.

The assembling of each of the contact terminals 2 is facilitated by inserting the end of the bent contact portion 23 thereof from underneath the body 1, into the corresponding terminal hole 15. When any one of the contact terminals 2 is properly inserted into the designated location inside body 1 of the male connector, as is seen in the cross-sectional view of FIG. 4 of the male connector of FIG. 1, the flexible one-way latching protrusions 21 formed at about the center portion of the contact terminal 2 serves to prevent its accidental removal out of the body 1. This may be facilitated by, for example, the end of the latching protrusion 21 resting on the corresponding protruding/blocking/stopping planes formed inside the shaft of the terminal hole 15. When the latching protrusions 21 are successfully resting on their respective blocking/protruding/stopping planes, the entire contact terminal 2 may be placed in the spatial relationship with the body 1 as shown in FIG. 2. This means that the soldering ends 22 of the contact terminals 2 are properly aligned in the recessed alignment slot 14, ready for mounting onto the printed circuit board.

Figure 4:
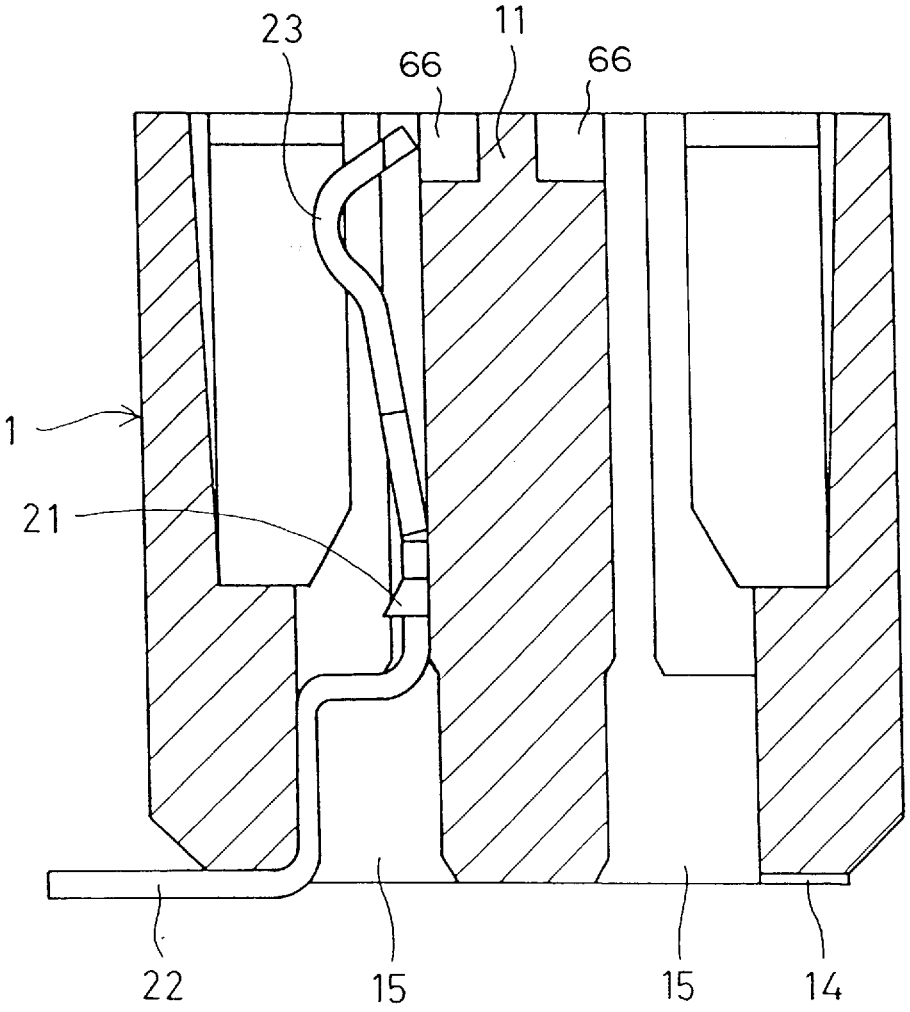
FIG. 4 is a cross-sectional view of the male connector showing the cross section taken along the VI—VI line of FIG. 1.

FIG. 4 is a cross-sectional view of the male connector showing the cross section of the assembled male connector taken along the VI—VI line of FIG. 1. The cross-sectional indicates the relative location of the contact terminal 2 and the body 1 of the male connector. As was explained above, only one contact terminal 2 is shown in the drawing for the purpose of visual inspection. The bent contact portion 23 of the installed contact terminal 2 is protruding out from the general side wall surface of the central connecting block 11. Grooves 66 provide additional space for flexing motion of the bent contact portion 23.

Due to the fact that the contact terminal 2 is of a double-L configuration having three bent curves (not including the bent contact portion 23), no buckling phenomena may result on the contact terminal 2. This is because that the stress due to bending torque in the contact terminal 2 when it is assembled by insertion of the terminal into the terminal hole 15 may be absorbed by the resilience nature of the metal contact terminal 2 itself.

Further, the recessed alignment slot 14, as already indicated above, serves to maintain a contact terminal 2 in its proper position for facilitating precise mounting of the male connector over the surface of the printed circuit board. Meanwhile, a horizontal section of the contact terminals 2 at about a center portion serves to constitute a blocking section for preventing the taking in of the solder as a result of the capillary phenomena.

Figure 5:
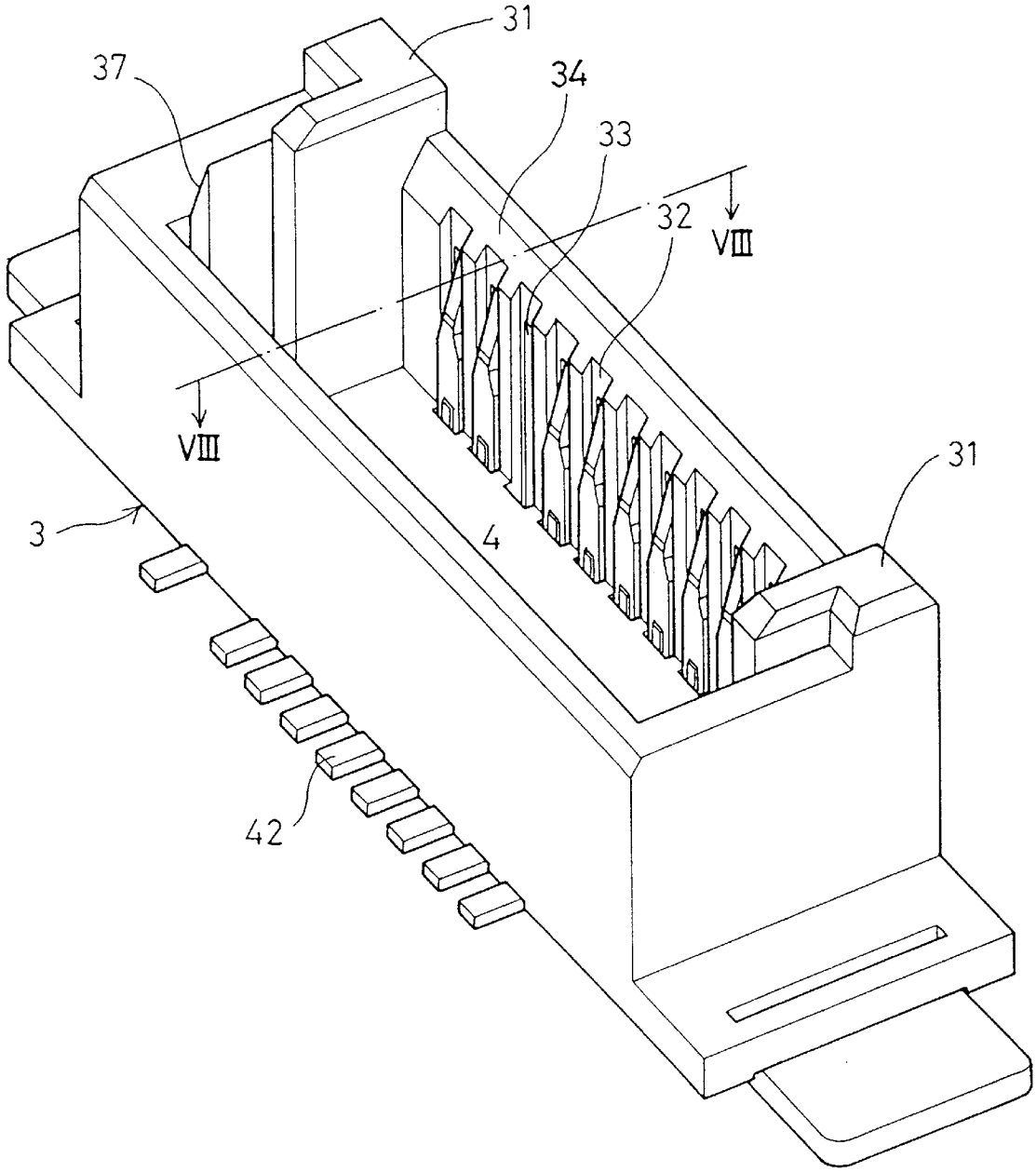
FIG. 5 is a perspective view of a female connector in accordance with the preferred embodiment of the present invention.
Figure 6:
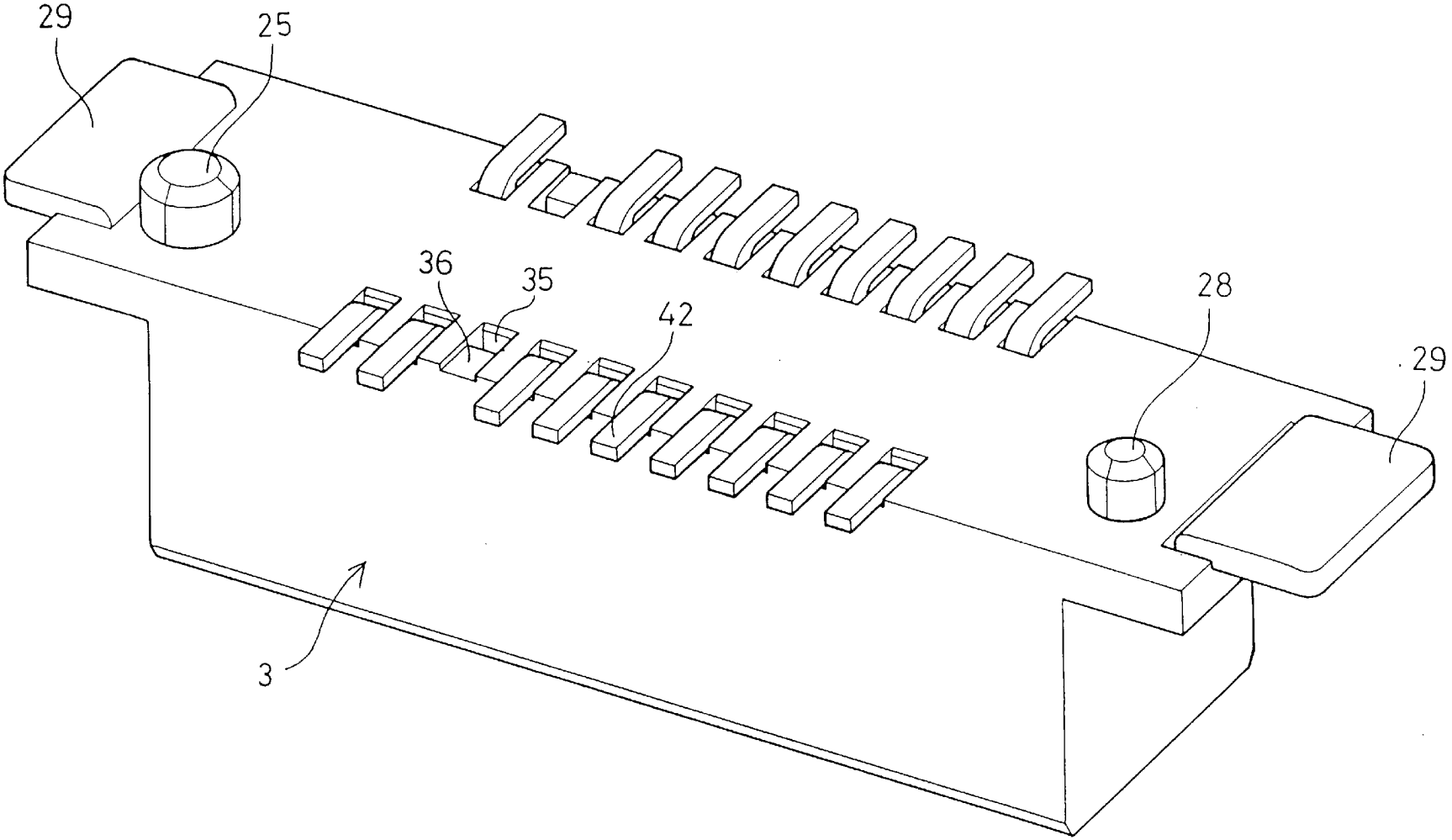
FIG. 6 is a perspective view of the female connector of FIG. 5 shown in another perspective angle.

Next, reference is directed to the description of the female connector that is utilized to match the male connector described above to constitute the connector pair. Refer to FIGS. 5 and 6 of the drawing. FIG. 5 is a perspective view of a female connector in accordance with the preferred embodiment of the present invention and FIG. 6 is a perspective view of the female connector of FIG. 5 shown in another perspective angle. As is seen in the drawing, the female connector comprises a body 3 made of, for example, plastic and a number of contact terminals 4.

The body 3 of the female connector has a dimension and shape that is suitable for smooth insertion into the internal space of the body 1 of the male connector of FIG. 1. That is to say, the external side walls of the body 3 of the female connector is brought to be facing the internal side walls of the body 1 of the male connector, with reasonable tolerances therebetween to allow for the insertion and the detachment as required.

When body 3 of the female connector is inserted into the body 1 of the male connector for facilitating the connector connection, the internal hollow space of body 3 of the female connector is matchingly suitable for receiving the relative insertion of the central connecting block 11 of the male connector. Two generally L-shaped alignment blocks 31 are each located at the longitudinal ends of the body 3. These L-shaped alignment blocks 31 are used to mate with the respective L-shaped alignment slots 12 in the body 1 of the male connector when the connectors are connected together. At the corner opposing one of the L-shaped alignment block 31 is an orientation edge 37, for matching the orientation cut edge 17 of the body 1 of the male connector. The combined presence of the orientation edge and the L-shaped alignment blocks ensures that the female connector may only be connected to the male connector in one designated direction. The reversed connection is made impossible with these alignment structures.

The contact terminals 4, as seen in the FIG. 5, are populated along both the longitudinal internal side walls of the body 3 of the female connector, although only one row of contact terminals 4 are shown. The population of the contact terminals 4 are spaced at a pitch so as to match a pitch of the contact terminals 2 found in the body 1 of the male connector.

The contact terminals 4 for the female connector are each contained in the corresponding contact terminal containing space 32 formed on the internal side wall surface of the body 3. As is seen in the perspective view of FIG. 5, an even smaller contact terminal tip-containing slot 33 is further formed in the terminal containing space 32. Each of the terminal containing spaces 32 is utilized to house the main section of the contact terminal 4 for the female connector, while the tip-containing slot 33 is utilized to contain the tip of the contact terminal 4.

Referring to FIG. 6 of the drawing, which reveals the bottom side of the female connector. As was similar to the male connector, two rows of terminal holes 35 are formed in the bottom surface of the female connector. Each of the terminal holes 35, again, has its corresponding alignment slot 36 connected for containing the soldering end 42 of the contact terminal 4 when installed. In general, the bottom arrangement of the female connector is similar to that of the male connector described above. For example, the body end plates 29, as well as the positioning studs 25 and 29 as shown in FIG. 6 should have the same configurational conditions as that of the male connector, allowing the proper orientation and mounting of the female connector on the surface of the printed circuit board.

Figure 7:
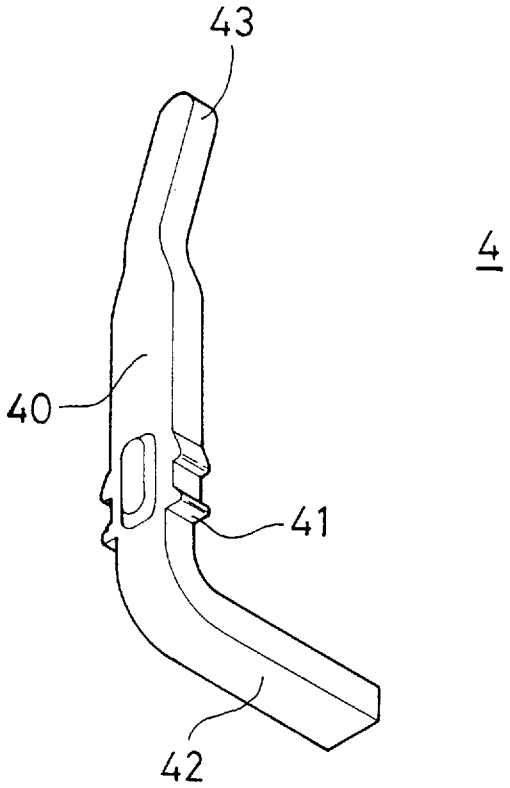
FIG. 7 is a perspective view of the contact terminal for the female connector of FIG. 5.

As is seen in FIG. 7, the perspective view of a contact terminal 4 for the female connector is shows that the terminal 4 is a single bent contact piece made of, for example, electrically conducting metal, having a soldering end 42 extending straight in the direction substantially perpendicular to the main section 40 of the terminal 4. At the bending portion of the contact terminal 4, a pair of one-way latching protrusions 41 are formed at both sides of the main section 40 thereof. A contact receiving end 43 extends generally in the direction of the main section 40 of the contact terminal 4, while slightly inclining toward the extending direction of the soldering end 42.

Figure 8:
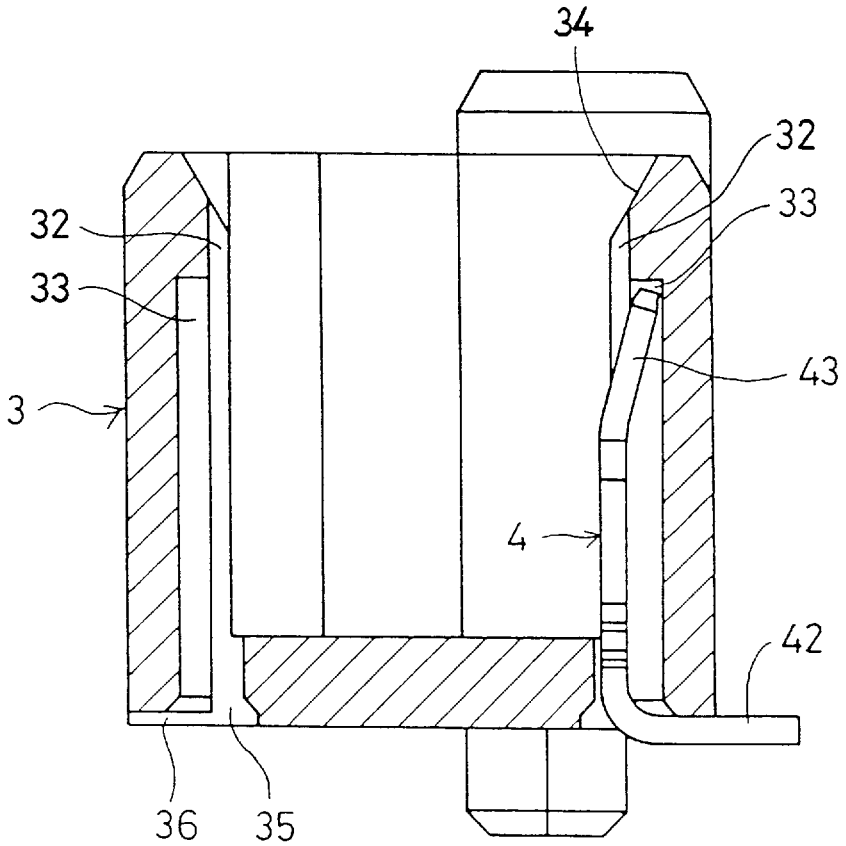
FIG. 8 is a cross-sectional view of the female connector showing the cross section taken along the VIII—VIII line of FIG. 5.

FIG. 8 is a cross-sectional view of the female connector showing the cross section taken along the VIII—VIII line FIG. 5. As is seen in the cross-sectional view, the installation of each of the contact terminal 4 is facilitated by inserting the contact receiving end 43 thereof into the terminal hole 35, with its soldering end 42 extending outward in the direction perpendicular to the longitudinal axis of the body 3 of the female connector. The one-way latching protrusions 41 of the contact terminal 4, as similar in the case of the contact terminal 2 for the male connector, serves to prevent the terminal 4 from accidental disengagement in the body 3.

Also, the contact receiving end 43 of the terminal 4 is slightly inclining toward the depth of the side wall of the body 3, dipping its tip into the terminal tip-containing slot 33. This slight-inclining of the contact receiving end 43 for the contact terminal 4 provides for the smooth engagement of the bent contact portion 23 of the contact terminal 2 in the male connector with the main section 40 of the contact terminal 4 for the female connector. This is important since to have the male and female connectors securely and firmly connected together, the bent contact portion 23 of terminal 2 must slidingly pass through the contact receiving end 43 of terminal 4, as is comprehensible in the cross-sectional view of FIG. 9, a cross-sectional view of the male and female connectors of FIGS. 4 and 8 in an insertingly connected combination status.

Figure 9:
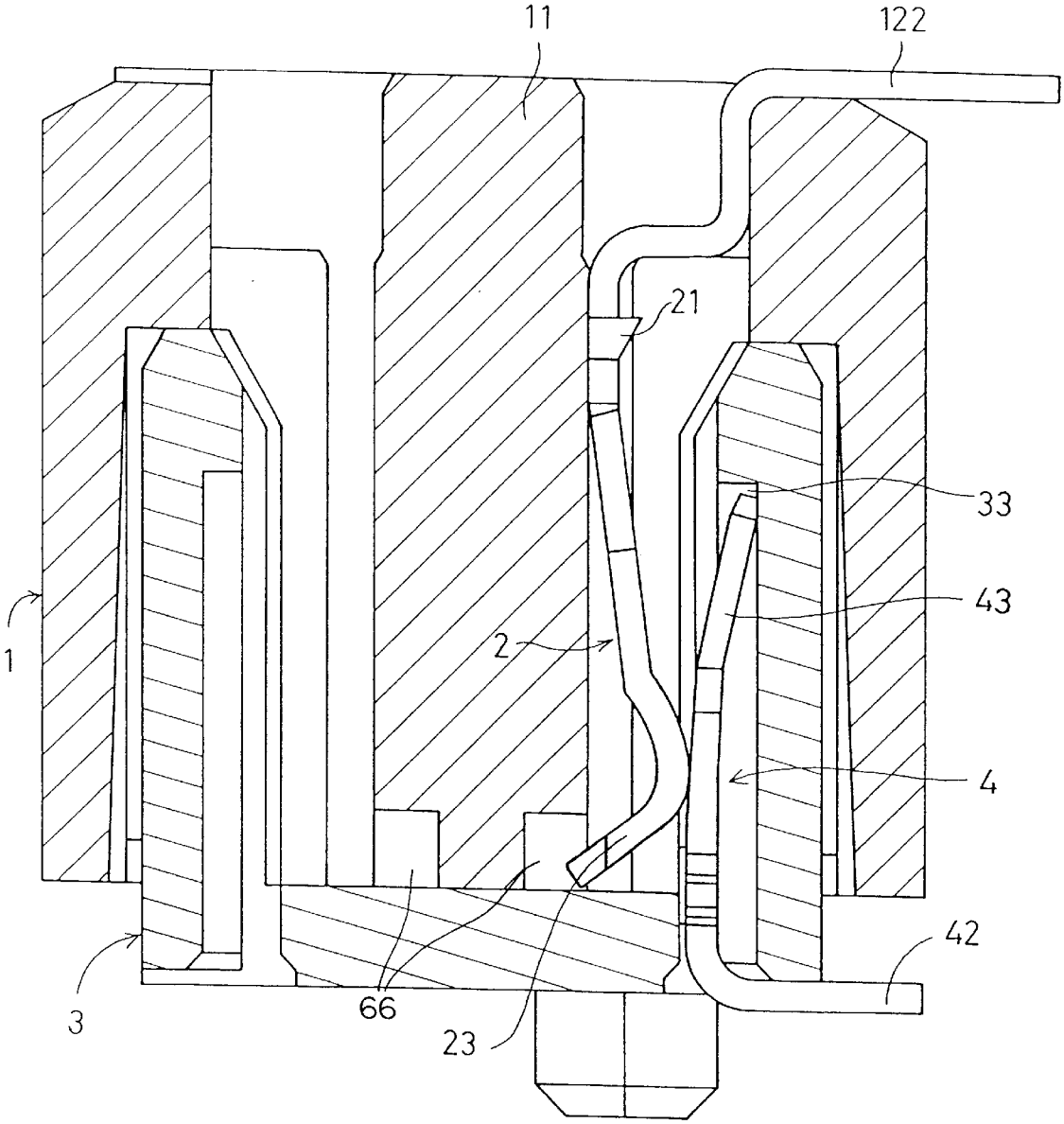
FIG. 9 is a cross-sectional view of the male and female connector of FIGS. 4 and 8 in an insertingly connected combination status.

In the cross-sectional view of FIG. 9, it is clearly shown the relative spatial relationships between the structural configuration portions of the male and female connectors. With the central connecting block 11 of the male connector entirely inserted into the hollow space of the female connector, the pair of contact terminals 2 and 4 of the two connectors respectively can be placed in a firm electrical contact position. The bent contact portion 23 of the terminal 2 of the male connector contacts the main section 40 of the contact terminal 4 of the female connector under the resilient pressure generated by the two pieces of contact terminals. The bent and inclined configuration of the terminals 2 and 4 respectively provides for the easy and smooth inserting contact of the two connectors, as well as the easy and smooth disengagement therebetween.

On the other hand, the soldering ends 22 and 42 of the contact terminals 2 and 4 for the male and female connectors respectively may be correctly soldered to their respective printed circuit board, thereby providing the electrical connection between the two printed circuit boards.

As persons skilled in this art may well appreciate, the above description of the preferred embodiment of the present invention is employed for the description, not for the restriction to the present invention. Modifications to the outlined embodiment of the present invention may be apparent and should be considered to be within the scope of the present invention that is recited in the claims.

What is claimed is:

1. A connector apparatus for electrically connecting printed circuit boards comprising:

a connector body, having a central connecting block protruding from a bottom of the block, and having formed on two longitudinal side walls thereof a plurality of parallel spacer walls extending in a direction perpendicular both to a longitudinal axis and said bottom of said block, at least two grooves formed on a top portion of said block along a respective longitudinal side wall, an external surface of said bottom having formed thereon a plurality of contact terminal holes each connected to and aligned with a corresponding contact terminal containing space defined between every consecutive two of said spacer walls, alignment slots formed on the exterior bottom surface of said body and connecting to an exterior opening of each of said contact terminal holes, a plurality of stopping planes formed inside said terminal holes; and a plurality of double-L-shaped contact terminals each having a bent contact portion installed inside a corresponding one of said contact terminal containing spaces, at least one free end extending from said bent contact portion and spaced apart from one of said side walls at one of said grooves, said at least one free end being suspended in one of said contact terminal containing spaces wherein said spacer walls align said at least one free end during compression while each groove maintains said at least one free end in a cantilever state spaced from said block to provide additional space for flexing of each free end, one-way latching protrusions formed on a center section thereof for latching into the stopping planes, and a soldering end extending out of a corresponding one of said contact terminal holes in a direction perpendicular to the longitudinal axis of said body, whereby flexibility of said contact terminals is enhanced while buckling during compression of said contact terminals is substantially reduced.

2. The connector apparatus for electrically connecting printed circuit boards of claim 1, wherein said connector body further comprises an opened rectangular box for containing said central connecting block.

3. The connector apparatus for electrically connecting printed circuit boards of claim 1, wherein said soldering end of each of said contact terminals is contained in the corresponding one of said alignment slots on said external bottom surface of said body.

4. The connector apparatus for electrically connecting printed circuit boards of claim 1, wherein L-shaped alignment slots are formed between the end walls of said body and the corresponding end of said central connecting block.

5. The connector apparatus for electrically connecting printed circuit boards of claim 1, wherein one end of said central connecting block has an orientation cut edge.

6. The connector apparatus for electrically connecting printed circuit boards of claim 1, wherein said bent contact portion of said contact terminal is spaced apart from the surface of the longitudinal side wall of said central connecting block.

7. The connector apparatus for electrically connecting printed circuit boards of claim 1, wherein bottom surfaces of said soldering ends of said plurality of contact terminals are spaced apart from said external bottom surface of said body.

8. The connector apparatus for electrically connecting printed circuit boards of claim 1, wherein said external bottom surface of said body further having at least two positioning studs protruding from said bottom surface, and said at least two studs having different dimensions.

9. A connector apparatus for electrically connecting printed circuit boards comprising:

a connector body comprising a rectangular box, said rectangular box having two end walls and two longitudinal internal side walls with a plurality of parallel contact terminal containing spaces formed on said side walls extending in a direction perpendicular both to a longitudinal axis and a bottom of said body, said contact terminal containing spaces being defined by protrusions extending from at least one of the side walls, said contact terminal containing spaces further including contact terminal tip-containing slots, the slots being defined in the at least one side wall within respective contact terminal containing spaces, an external surface of said bottom having formed thereon a plurality of contact terminal holes each connected to and aligned with a corresponding one of said contact terminal containing spaces, and alignment slots formed on the exterior bottom surface of said body connecting to an exterior opening of each of said contact terminal holes, a plurality of stopping planes inside said terminal holes; and a plurality of L-shaped contact terminals each having a slightly inclined contact receiving end being aligned by wall surfaces of a corresponding one of said contact terminal containing spaces, each receiving end contacting the at least one wall in a respective contact terminal tip-containing slot wherein a main section of each contact terminal is spaced apart from and out of engagement with a respective contact terminal tip containing slot, said slots provide additional space for flexing of said terminals, one-way latching protrusions formed on a center section thereof for latching into the stopping planes, and a soldering end extending out of a corresponding one of said contact terminal holes in a direction perpendicular to the longitudinal axis of said body, whereby flexibility of said contact terminals is enhanced while buckling during compression of said contact terminals is substantially reduced.

10. The connector apparatus for electrically connecting printed circuit boards of claim 9, wherein said soldering end of each of said contact terminals is contained in a corresponding one of said alignment slots on said external bottom surface of said body.

11. The connector apparatus for electrically connecting printed circuit boards of claim 9 wherein an L-shaped alignment block is formed at each of the end walls of said body.

12. The connector apparatus for electrically connecting printed circuit boards of claim 9, wherein one side wall of said body has an orientation edge.

13. The connector apparatus for electrically connecting printed circuit boards of claim 9, wherein a center portion of each said contact terminals has a surface spaced apart from the surface of said longitudinal internal side wall of said body.

14. The connector apparatus for electrically connecting printed circuit boards of claim 9, wherein bottom surfaces of said soldering ends of said plurality of contact terminals are spaced apart from said external bottom surface of said body.

15. The connector apparatus for electrically connecting printed circuit boards of claim 9, wherein said external bottom surface of said body further having at least two positioning studs protruding from said bottom surface, and said at least two studs having different dimensions.

* * * * *